US005722844A

United States Patent [19]

Schraeder

[11] Patent Number: 5,722,844

[45] Date of Patent: Mar. 3, 1998

[54] WELLHEAD JUNCTION SYSTEM

[76] Inventor: Leo Bryce Schraeder, Hidalgo de Pinto 762, Quita, Ecuador

[21] Appl. No.: 627,966

[22] Filed: Apr. 4, 1996

[51] Int. Cl.[6] ..... H01R 4/60

[52] U.S. Cl. ..... 439/194; 439/190

[58] Field of Search ..... 439/190, 191, 439/194, 195; 166/65.1

[56] References Cited

U.S. PATENT DOCUMENTS

| | | | |
|---|---|---|---|
| 4,438,996 | 3/1984 | Zehren | 439/194 X |
| 4,941,349 | 7/1990 | Walkow et al. | 439/194 X |
| 5,370,545 | 12/1994 | Laurent | 439/194 X |
| 5,389,003 | 2/1995 | Van Steenwyk et al. | 439/191 |

*Primary Examiner*—Khiem Nguyen

*Attorney, Agent, or Firm*—Litman, McMahon and Brown, L.L.C.

[57] ABSTRACT

A junction system is provided for an electrical cable and a capillary tube at a wellhead. The junction system includes a conduit subsystem, a head casing assembly and a plurality of connector assemblies located within the head casing assembly. The connector assemblies are mounted within the head casing assembly and each connects the conductors of a power cable device lead and a power cable source lead. The head casing assembly includes an insulator and an inert liquid for sealing and insulating the electrical connections therein. The head casing assembly is mounted exteriorally of the wellhead.

29 Claims, 13 Drawing Sheets

WELLHEAD JUNCTION SYSTEM

BACKGROUND OF THE INVENTION

1. Field of the Invention

The present invention relates generally to electrical junction systems, and in particular to a wellhead junction system for electrical power cables for electrical submersible pumps and capillary tubes for chemical injection.

2. Description of the Related Art

Electrical junctions are common in electrical systems of various types. They generally involve electrically conductively joining two or more electrical components or conductors. For example, electrical wires and cables are joined by a wide variety of methods, which typically have several common objectives. These include insulating the conductors from each other, providing a substantial contact area for effective current carrying capabilities across the junction and protection from the elements to avoid corrosion, electrolysis, etc.

Oil and gas wellheads present particularly challenging applications for electrical connectors and the like. Such connections are commonly required to electrically couple power sources with electrical submersible pumps (ESP's) which are commonly installed downhole in the oil or water producing zones of a particular well. In such applications the wellheads are generally exposed to the environment, and high pressure wells commonly have relatively high operating pressures which accumulate within the well casings and must be contained by the wellheads and devices mounted thereon. Moreover, well gases can contain significant amounts of sulfur, humidity and other elements which tend to be corrosive, thereby exacerbating the problems associated with harsh environmental conditions and severe usage. In addition to the electrical wiring connections, chemical injection ports are often provided at a wellhead for the injection of appropriate chemicals to enhance well production.

A common type of device used in making such wellhead connections is referred to as a "Penetrator" wherein conductors are spliced together and include cylinders which enclose the splices individually or collectively. The enclosing cylinders commonly extend both downwardly and upwardly from the tubing hangers in the wellheads. Sealants such as rubber and epoxy are commonly used in establishing the Penetrator connections. Moreover, Penetrator connectors typically require lower electrical connections of the electrical leads from the downhole devices and upper electrical connections of the electrical leads from the power sources. A common problem with Penetrator connectors relates to their lack of reusability. In particular, natural gas tends to migrate into the sealing components of the Penetrator connectors and cause deterioration of same. Penetrator connectors can cost several thousands of dollars, and since they are non-reusable such costs are typically incurred every time a well is worked over.

Another problem relating to prior art Penetrator connectors is that the cable connections, which are sometimes referred to as "pigtail" connections, tend to be unreliable and susceptible to problems associated with leakage. Still further, installation and replacement of Penetrator connection systems tend to be relatively time consuming operations which often require the services of trained technicians and involve significant down time.

Capillary tube connections also tended to be relatively time-consuming and expensive. Previous techniques for installing capillary tubes often involved separate tube connections. Still further, previous Penetrator-type connecting devices often involve peripheral equipment, workover rig crews, engineers and technicians to accomplish installation, replacement or servicing. The present invention addresses some or all of the aforementioned problems associated with prior art wellhead junction systems such as Penetrator systems.

SUMMARY OF THE INVENTION

In the practice of the present invention, a junction system is provided for a wellhead including a casing, production tubing, a tubing hanger and a tubing head. A bypass extends through the tubing hanger and mounts an access housing. A head casing assembly is mounted on the access housing by means of a riser tube and includes a casing body. The casing body forms a bore which receives connector assemblies therein. The power cable is bent approximately 180° within the casing body bore. The head casing assembly includes seals mounted therein for resisting pressure from the wellhead. The electrical connector assemblies connect the power cable conductors of the device lead to the conductors of the source lead.

OBJECTS AND ADVANTAGES OF THE INVENTION

The principle objects and advantages of the present invention include: providing a junction system for a wellhead; providing such a junction system which is adapted for electrical power cable connections and for chemical capillary tube connections; providing such a junction system which is resistant to pressure from the well; providing such a junction system which electrically isolates the conductors of a power cable; providing such a junction system which can be serviced exteriorally to a wellhead; providing such a junction system which is relatively economical and efficient to replace; providing such a junction system which is highly resistant to the elements and wellhead conditions; providing such a junction system which can be positioned at various locations with respect to a wellhead and the equipment mounted thereon; providing such a junction system which can be configured to accommodate the requirements of various different applications; providing such a junction system which provides for relatively uncomplicated connections of electrical power cables to electrical submersible pumps; providing such a junction system which provides for the connection of capillary tubes in a relatively uncomplicated manner from the exterior of the wellhead; providing such a junction system which can be installed above ground beside a wellhead; providing such a junction system which can be installed after a tubing hanger and a wellhead are in place; providing such a junction system which can be installed, replaced and serviced exteriorally to the wellhead; providing such a junction system which can eliminate the need for a separate capillary tube connection system; providing such a junction system which can eliminate conventional electrical power conductor splices and replace same with an encapsulated, pressure and electrical insulated connection system exterior to the wellhead; providing such a junction system which utilizes liquid as a barrier to gas penetration; providing such a junction system which utilizes a bypass to place the cable and tube connections above ground beside the wellhead; providing such a junction system which is hermetically sealed; providing such a junction system which is adaptable to a wide range of electrical power cables; providing such a junction system which can be installed, replaced and serviced by personnel with relatively little training or instruction; providing such a junction system which is reusable; providing such a junction system which can be installed by a single worker; and providing such a junction system which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
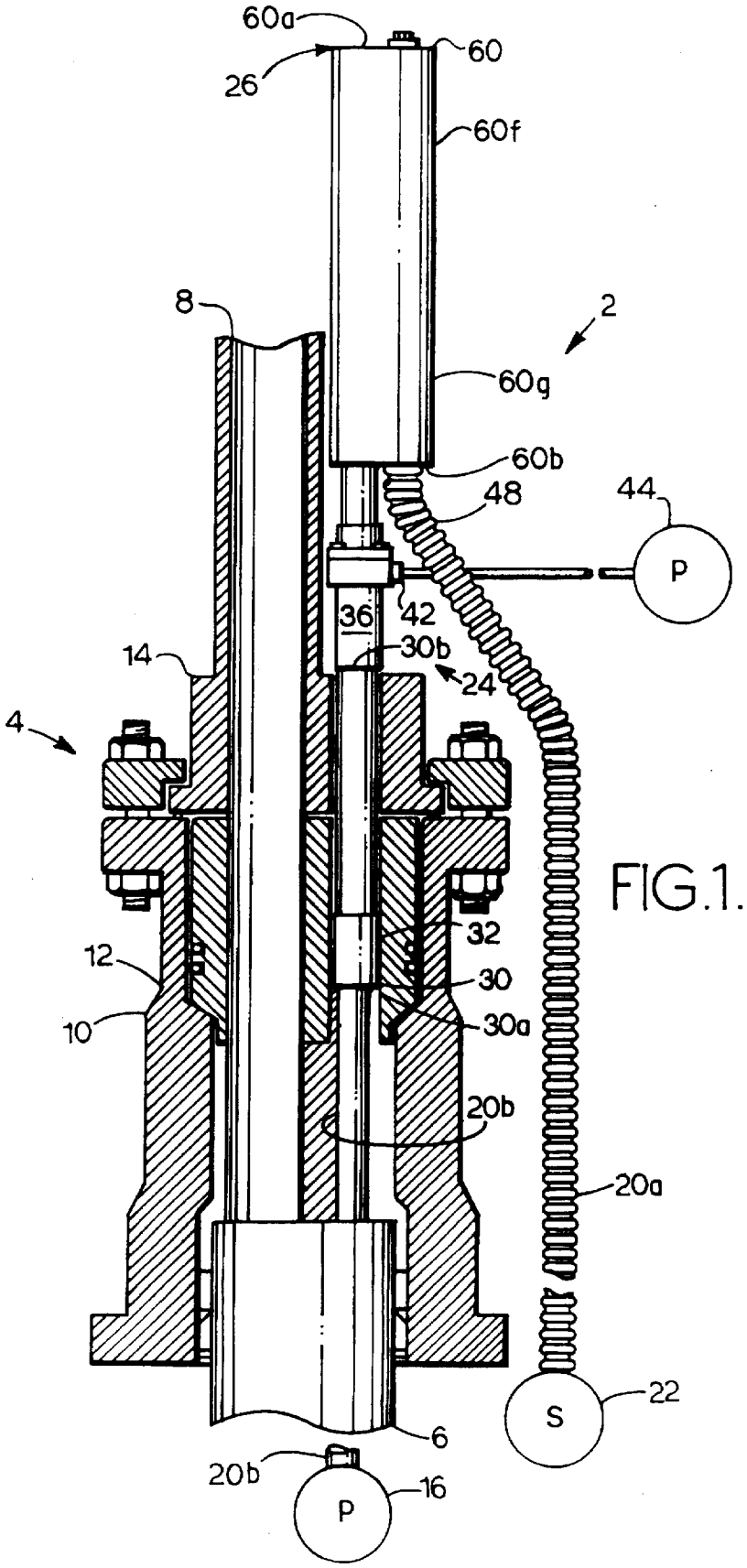
FIG. 1 is a vertical, cross-sectional view of a wellhead with a junction system embodying the present invention.
Figure 2:
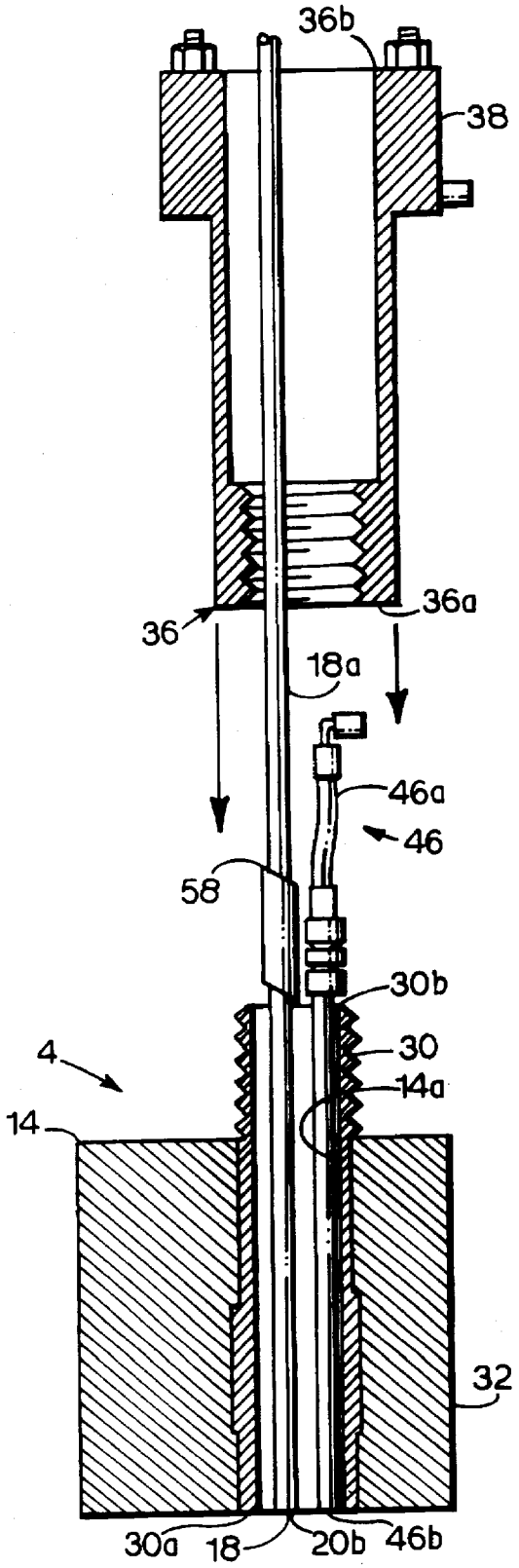
FIG. 2 is a fragmentary view thereof showing the installation of an access housing on a bypass thereof.
Figure 3:
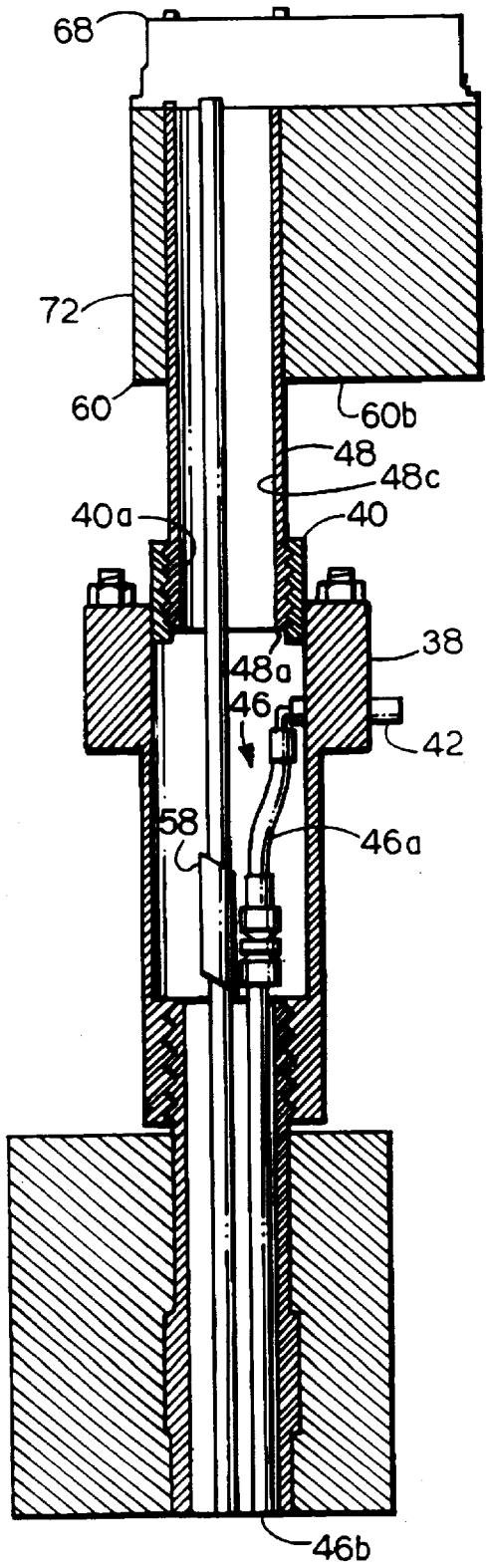
FIG. 3 is a fragmentary view thereof showing the installation of the access housing and the connection of a capillary tube assembly thereto.
Figure 4:
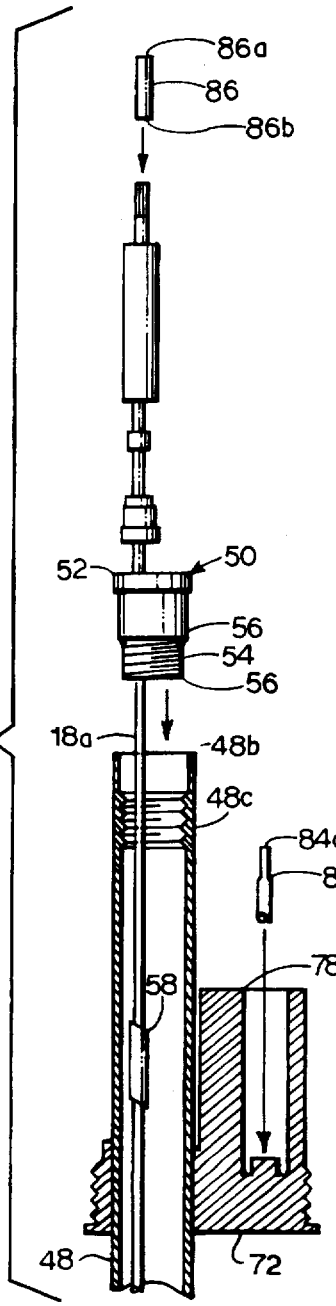
FIG. 4 is a fragmentary view thereof showing the installation of a buffer subassembly, a plug, a sleeve, a crimp and a conductor stud of a connector assembly.
Figure 5:
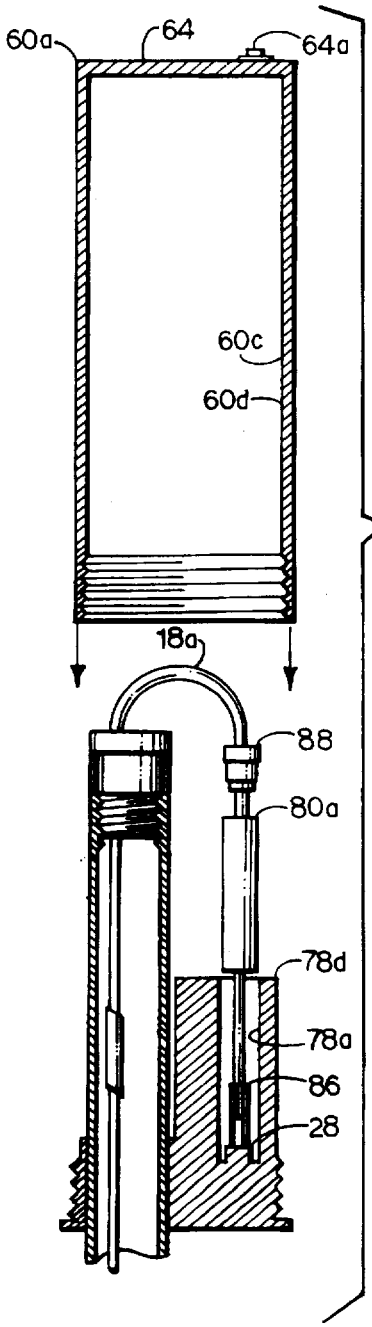
FIG. 5 is a fragmentary, vertical, cross-sectional view thereof showing the installation of a casing body upper section.
Figure 6:
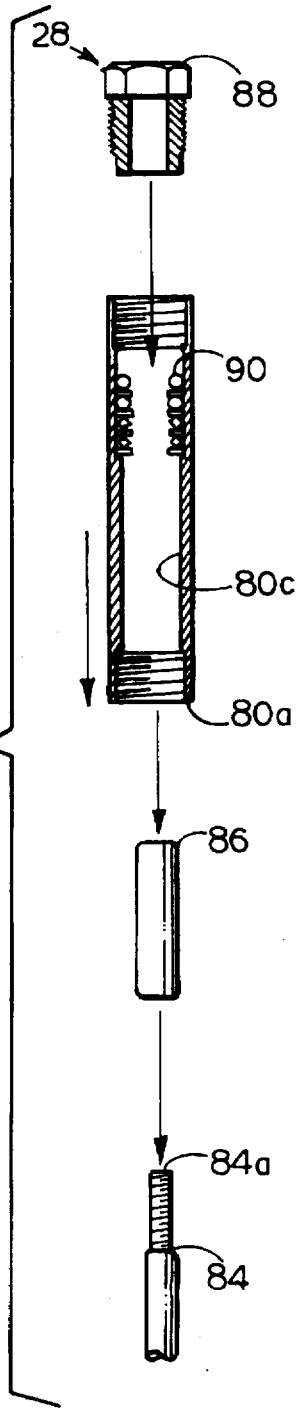
FIG. 6 is a fragmentary, exploded view of a portion of a connector assembly.
Figure 7:
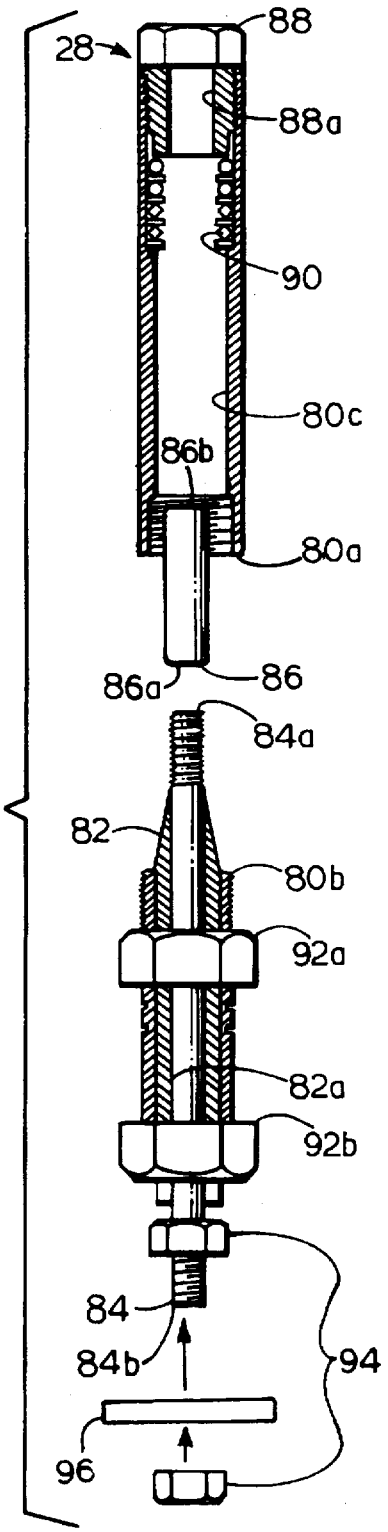
FIG. 7 is an exploded view of the connector assembly.
Figure 8:
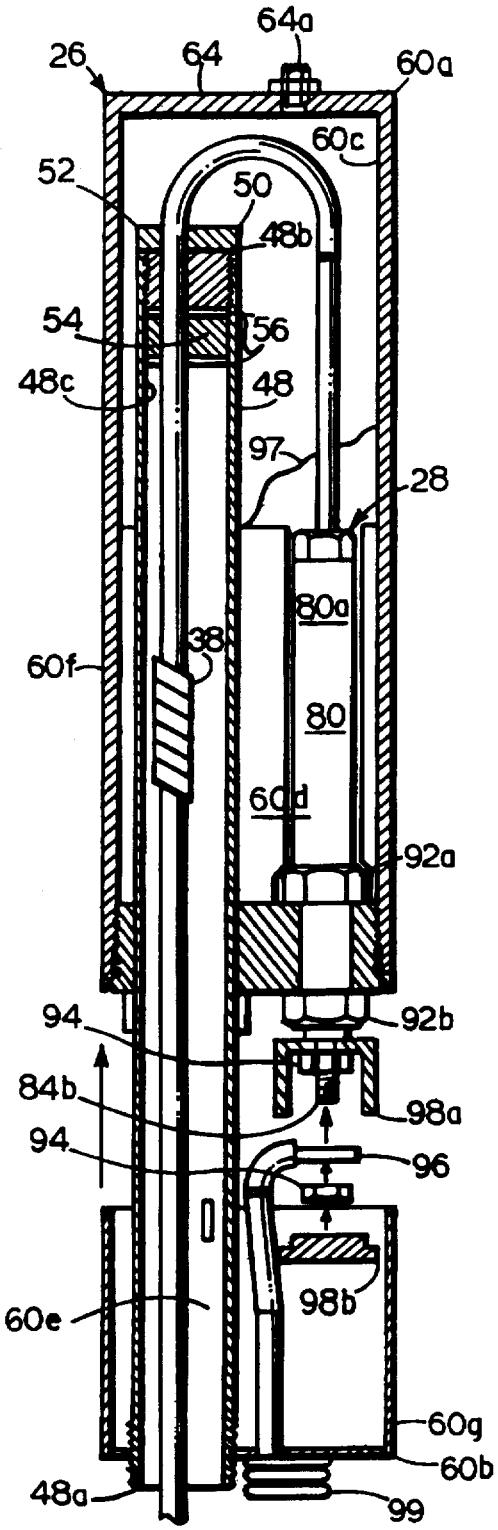
FIG. 8 is a vertical, cross-sectional view of a head casing assembly with portions exploded.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a wellhead power junction system embodying the present invention. The junction system 2 is particularly designed for application to a wellhead 4 including a casing 6 which telescopically receives production tubing 8. A tubing head 10 is mounted on an upper end of the casing 6 above grade and mounts a tubing hanger 12. A tubing head adapter 14 is mounted on the tubing head 10 and receives the production tubing 8, which connects to an appropriate storage facility, pipeline or the like. The tubing hanger 12 and the tubing head adapter 14 include respective bypass passages 12*a*, 14*a*, which are aligned.

An electric submersible pump 16 is located downhole in the casing 6 for pumping the production, i.e., oil or water, through the production tubing 8. The electric submersible pump 16 can operate on, for example, three-phase, alternating current electrical power provided by an electrical power cable 18 with insulated conductors 18*a,b,c*. The power cable 18 includes a source lead 20*a* connected to a power source 22, such as a generator, and a device lead 20*b* connected to the electric submersible pump 16.

The junction system 2 generally comprises a conduit subsystem 24, a head casing assembly 26 and a plurality of power cable connector assemblies 28.

II. Conduit Subsystem 24

The conduit subsystem 24 generally encloses the power cable 18 on both sides of the head casing assembly 26. The conduit subsystem 24 includes a bypass 30 extending through the bypass passages 12*a*, 14*a*. The bypass 30 has a lower end 30*a* positioned within the tubing hanger bypass passage 12*a* and sealed therein by O-rings 32 and an upper end 30*b* protruding upwardly from the tubing head adapter 14.

An access housing 36 includes a lower end 36*a* threadably mounted on the bypass upper end 30*b* and an upper end 36*b* mounting an annular collar 38 and a flange 40. A swaglock access port 42 is mounted in the collar 38 and is adapted for connection to a chemical pump 44 which feeds a capillary tube assembly 46 including a flexible upper section 46*a*

(e.g., Chemflex tubing) and a lower section 46b which extends down the bypass 30 and the casing 6 for injection of appropriate chemicals intended to enhance production and recovery. The flange 40 includes a female-threaded flange bore 40a which opens upwardly. A riser 48 includes a lower end 48a threadably received in the flange bore 40a, an upper end 48b and a riser bore 48c extending therebetween. The riser 48 extends into and terminates within the head casing assembly 26.

A buffer subassembly 50 is mounted in the riser upper end 48b and includes a plug 52 threadably received in the riser upper end 48b and compressing a fluid-pervious filter 54 between a pair of washers 56. The buffer subassembly 50 includes a plurality (e.g., three) of buffer passages 50a receiving respective cable conductors 18a,b,c in sealing engagement with the filter 54. A splice wrap 58 is provided where insulation on the cable 18 terminates within the riser bore 48c.

III. Head Casing Assembly 26

The head casing assembly 26 includes a casing body 60 with a closed upper end 60a, a closed lower end 60b, bore 60c forming upper and lower chambers 60d,e and upper and lower casing body sections 60f, 60g. The casing body upper end 60a is enclosed by a cap 64 with an access port 64a. A head casing base 68 is mounted in the casing body lower end 60b and has a plurality of connector passages 70 and a riser passage 72 extending therethrough. The casing body lower end 60b is enclosed by a bottom cover 76 which includes a power cable conductor opening 76a and a riser opening 76b.

Figure 9:
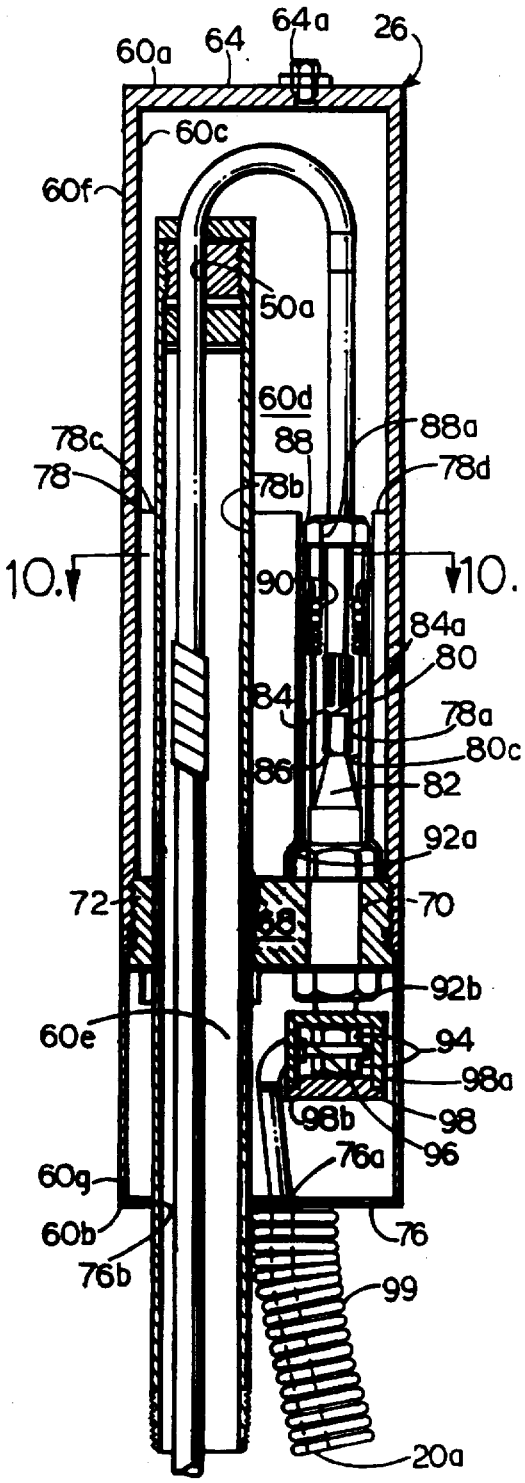
FIG. 9 is a vertical, cross-sectional view of the head casing assembly and a connector assembly therein.
Figure 10:
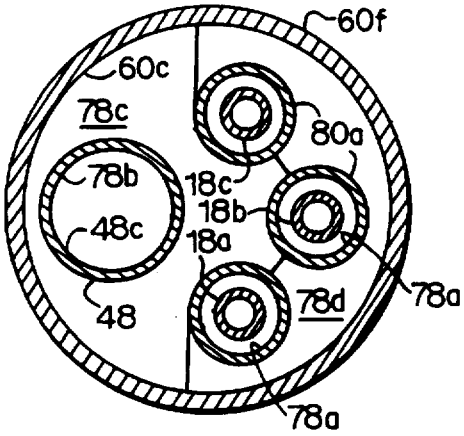
FIG. 10 is a horizontal, cross-sectional view of the head casing assembly and the connector assemblies therein, taken generally along line 10—10 in FIG. 9.

An insulator 78 comprises a non-conductive material, such as nylon, and includes a plurality of conductor passages 78a and a riser passage 78b. The insulator 78 includes first and second portions 78c, 78d as shown in FIG. 9. Insulator portion 78c includes the riser passage 78b. The conductor passages 78a are formed partly in each insulator portion 78c,d.

IV. Connector Assemblies 28

Each connector assembly 28 includes a sleeve 80 with upper and lower sections 80a, 80b which are threadably interconnected and which form a sleeve bore 80c. A nonconductive, insulating (e.g., plastic) liner 82 is located in the sleeve lower section 80b and has a liner passage 82a which receives a conductor stud 84 which includes upper and lower male-threaded ends 84a,b.

The conductor stud upper end 84a threadably receives the lower end 86a of a conductive crimp fastener 86 which includes an upper end 86b clamped on the end of a respective power cable device lead conductor 18a,b,c from which a portion of the insulation has been stripped to provide an electrically conductive contact between the conductor 18a,b,c and the conductor stud 84. The sleeve upper section 80a threadably mounts a plug 88 with a passage 88a receiving a respective cable conductor 18a,b,c and O-rings 90 sealingly engaging same.

The sleeve lower section 80b mounts upper and lower connector assembly mounting nuts 92a,b positioned above and below the base 68 and clamping same therebetween for clamping the sleeve lower section 80b thereon. The stud lower end 84b mounts a pair of conductor nuts 94 which clampingly and conductively engage an apertured conductor end 96 within a housing 98 including a receptacle 98a and a housing cover 98b.

The casing body bore upper chamber 62d can be filled through the access port 64a with an inert fluid having a specific gravity greater than 1.0, such as fluid available under the trade name "H-RED".

V. Installation and Operation

The junction system 2 is designed for installation on a wellhead 4 utilizing a procedure which is both relatively cost efficient and expeditious. The bypass 30 can be either welded to the wellhead 4 for a permanent installation or simply connected thereto with the O-rings 32 forming a fluid-tight seal and a threaded connection therebetween forming a removable connection. In removable, semi-permanent installations the O-rings 32 should be changed each time the bypass 30 is removed from the bypass passages 12a, 14a. Silicone grease should be applied to the O-rings 32 and the sealing faces of the tubing hanger bypass passage 12a, which should be clean and dry.

Next, the power cable device lead 20b and the capillary tubes 45 are pulled through the bypass 30 and extended therefrom a certain distance, for example, approximately six feet. The individual power cable conductors 18a,b,c are separated and their ends are stripped. The capillary tubes 45 are also stripped of material to a level below the bypass lower end 30a.

The wellhead 4 is installed and bolted in place with the bypass 30 protruding upwardly therefrom. If the power cable device lead 20 includes lead or plastic shielding, it is stripped off in the area within the access housing 36 and a splice wrap 58 is installed in its place. The capillary tube or tubes 45 are then cut at a location above the bypass upper end 30b and a length of flexible tubing 46a is applied thereto. The swaglock access port 42 is connected to the capillary tube upper section 46a for accessing same through the collar 38.

The head casing assembly base 68 can be placed on the riser 30 in proximity to the upper end 30b thereof and the buffer subassembly 50 is placed on the power cable device lead 20b with the conductors 18a,b,c thereof extending through the buffer subassembly 50. The plug 88 and the O-rings 90 are then placed over the conductors 18a,b,c and sleeves 80 are placed thereover. The crimp fasteners 86 can then be connected to the conductors 18a,b,c and crimped onto the stripped ends thereof. The conductor studs 84 can then be fastened onto the crimp fastener lower ends 86a by screwing them together and the conductor stud lower ends 84b are extended through the respective base connector passages 70. The mounting nuts 92a,b are tightened in place on the conductor stud 84 for clamping same in place on the base 68 extending through respective connector passages 70 thereof. The sleeve upper and lower sections 80a,b are threadably connected together with appropriate sealing material, such as Teflon-coated tape, therebetween for sealing the connection. Connections can also be sealed with silicon grease and other suitable sealing materials.

The nylon insulator 78 is applied in two portions 78c,d and the casing body 60 is threadably mounted on the base 68. An appropriate fill material having a specific gravity greater than 1.0, such as fluid available under the trade name "H-RED" is injected into the head casing assembly 26 interior through the access port 64a.

The conductor nuts 94 are used for threadably mounting the conductor ends 96 to the conductor stud lower ends 84b within the housing receptacles 98a, which are enclosed by the housing covers 98b. The power cable source lead 20a can be enclosed within an appropriate flexible metal hose leader 99 welded or otherwise attached to the bottom cover 76. The hose leader 99 can be buried if necessary and is routed to the power source 22. The bottom cover 76 is installed on the casing body lower end 60b.

In operation, the buffer subassembly 50 allows pressure to gradually equalize between the casing 6 and the upper chamber 60d of the head casing assembly 26. The H-RED inert potting material 97 functions to exclude moisture from the conductor studs 84 and the electrically conductive components. Thus, a relatively effective electrical connection can be formed with the junction system 2, which can be relatively easily accessed from the exterior of the wellhead 4 for servicing, replacement and the like.

VI. First Modified Wellhead Junction System 102

Figure 11:
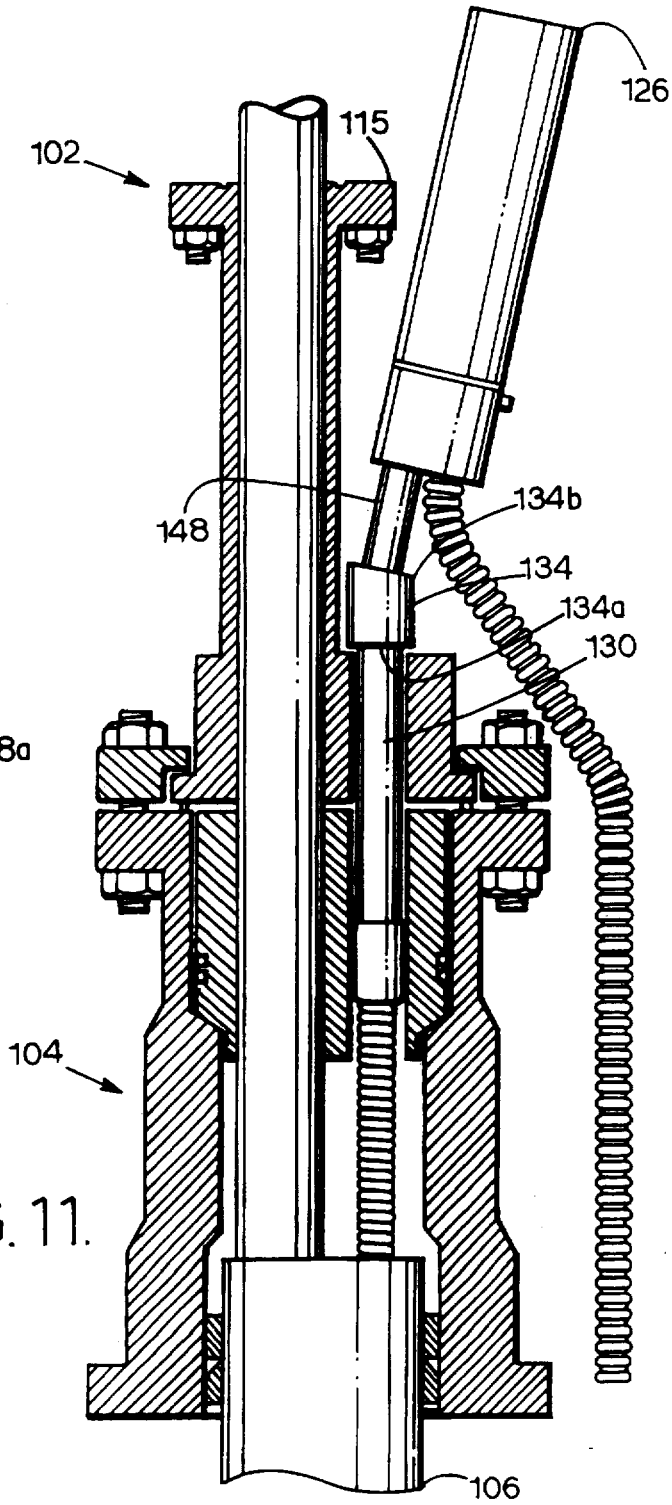
FIG. 11 is a vertical, cross-sectional view of a junction system comprising a first modified embodiment of the present invention with showing an alternative mounting of a head casing assembly with a 12° elbow.
Figure 11A:
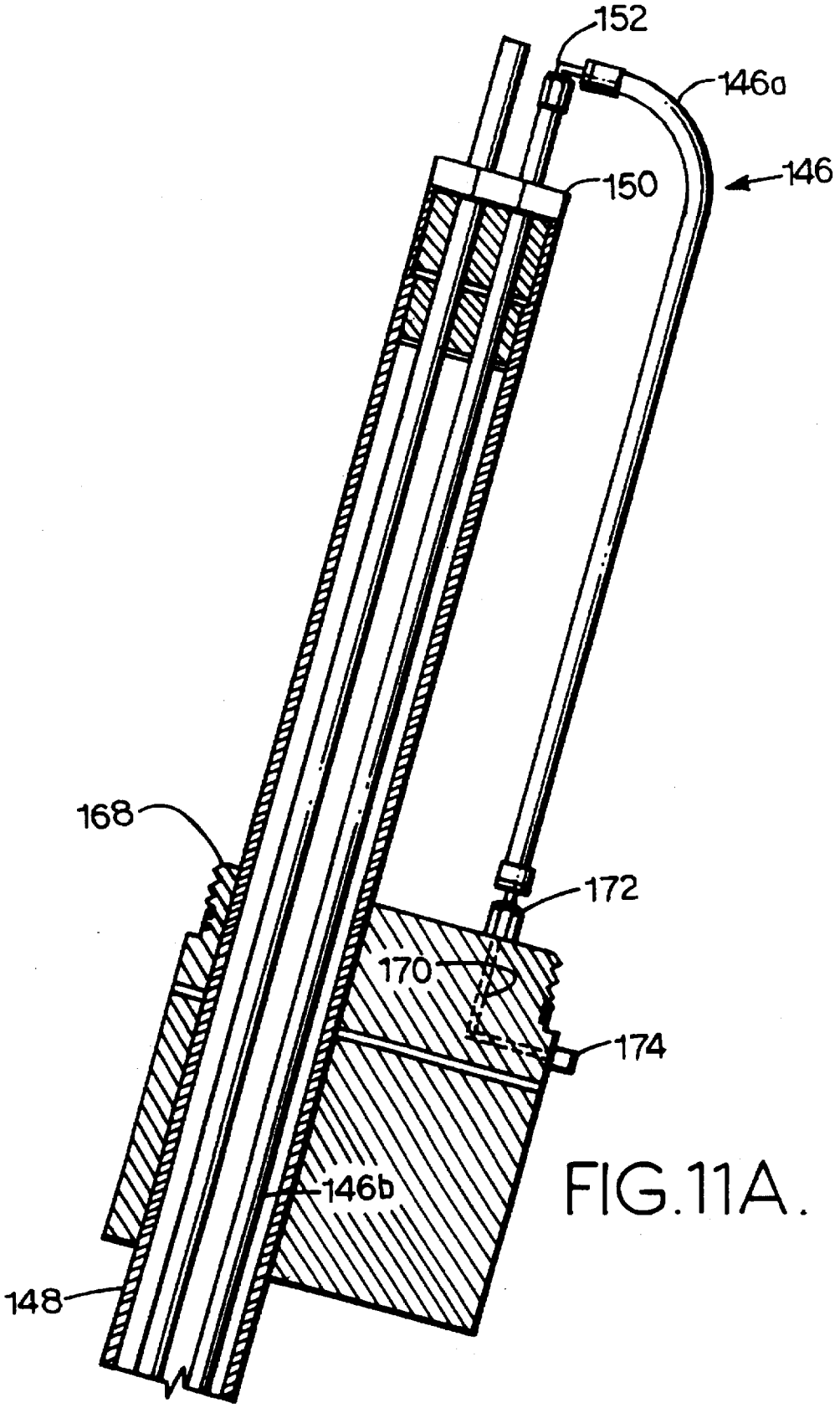
FIG. 11*a* is an enlarged, fragmentary, vertical cross-sectional view of the first modified junction system, particularly showing a capillary tube assembly thereof.
Figure 12:
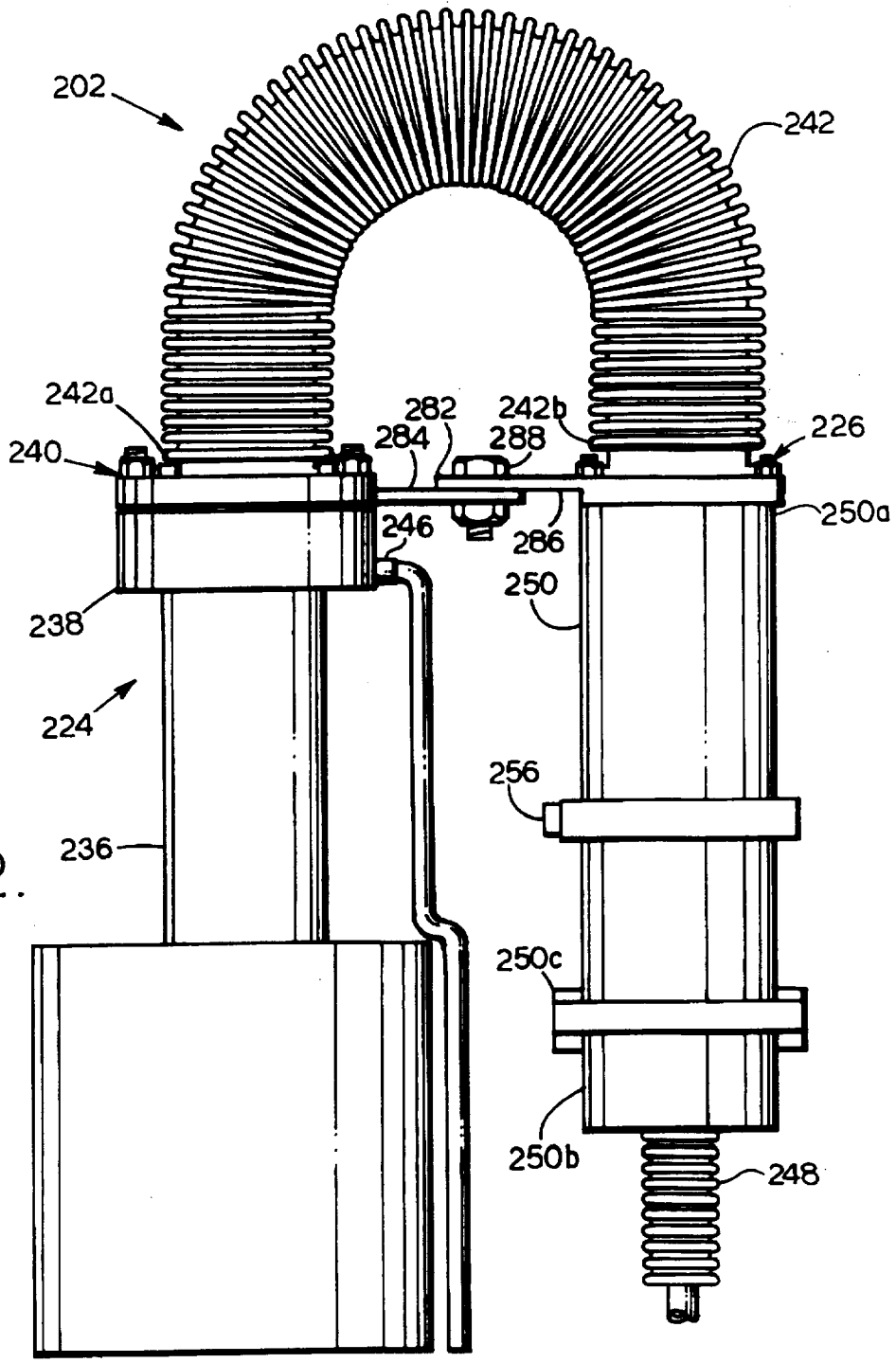
FIG. 12 is a vertical, cross-sectional view of a wellhead with a junction system mounted thereon comprising a first modified or alternative embodiment of the present invention.
Figure 13:
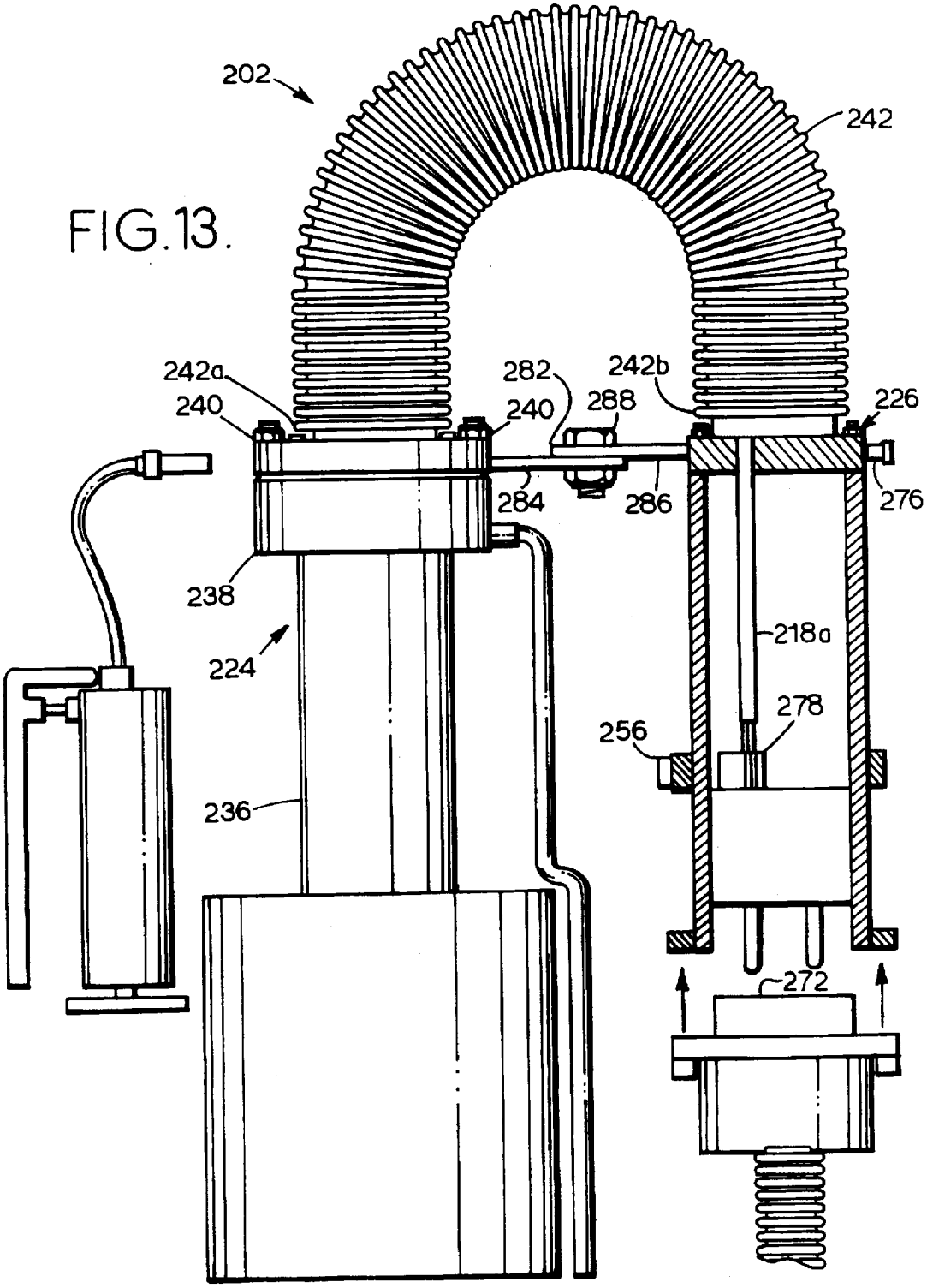
FIG. 13 is a vertical, cross-sectional view thereof showing silicon injection locations and a lower plug assembly exploded.
Figure 14:
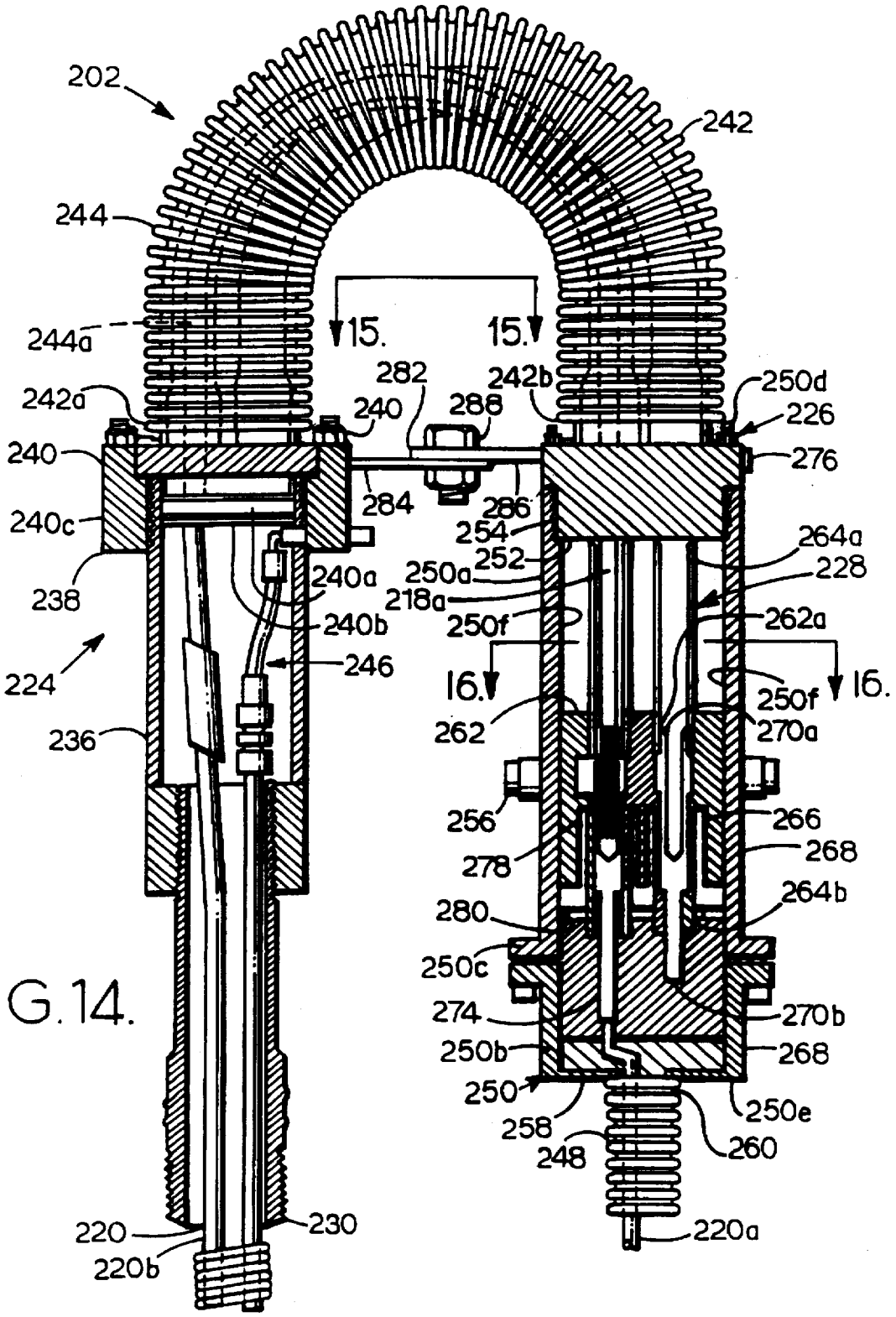
FIG. 14 is a vertical, cross-sectional view thereof.
Figure 15:
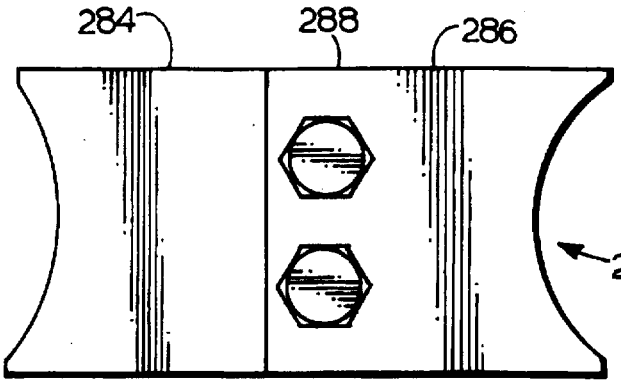
FIG. 15 is an enlarged, top plan view of a safety union subassembly thereof.
Figure 16:
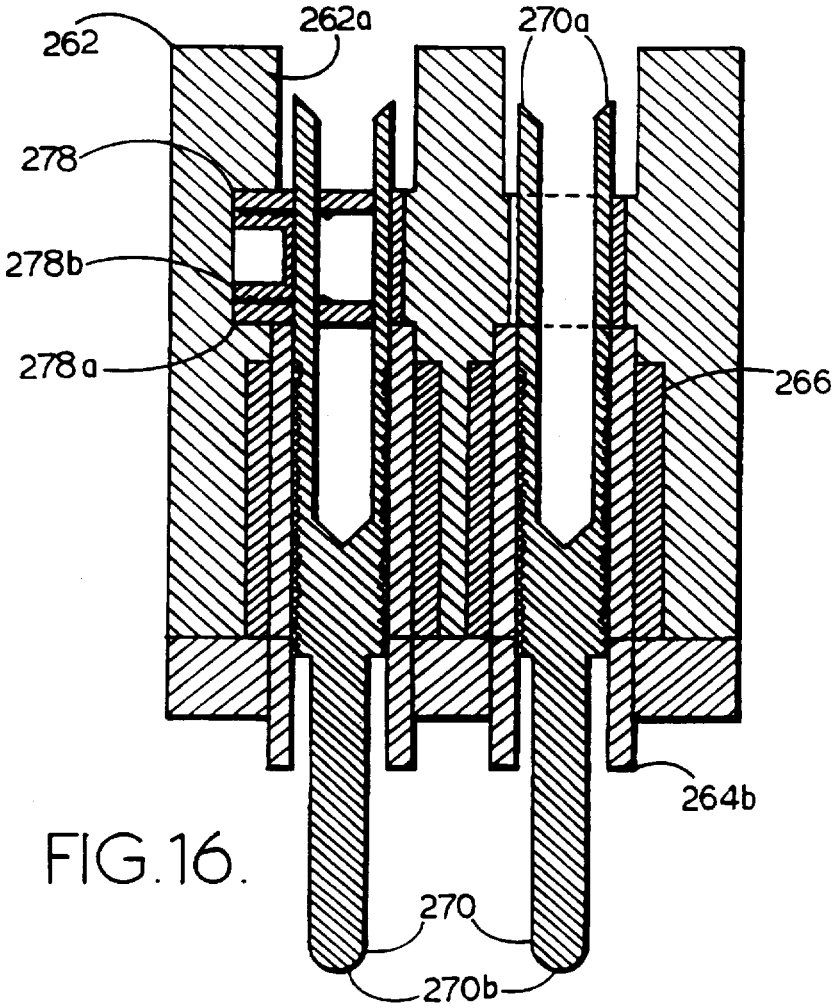
FIG. 16 is an enlarged, vertical cross-sectional view of a connector assembly thereof.

A first modified junction system for a wellhead 104 is shown in FIGS. 11 and 11*a* and is generally designated by the reference numeral 102. The junction system 102 includes an elbow 134 with a female-threaded first, lower end 134*a* threadably receiving the upper end of a bypass 130 and a female-threaded, second upper end 134*b* threadably receiving the lower end of a riser 148. The elbow ends 134*a,b* are skewed at an angle of approximately 12° with respect to each other whereby the riser 148 and a head casing assembly 126 mounted thereon are tilted approximately 12° from vertical to avoid a wellhead tubing head adapter flange 115 which mounts equipment associated with the wellhead 104 such as a valve, etc. (not shown).

It will be appreciated that elbows with various angular orientations can be used for installing the head casing assembly 126 at various desired angular orientations. For example, a 90° elbow could be utilized for installing the head casing assembly 126 in a substantially horizontal orientation.

A capillary tube assembly 146 is provided in the head casing assembly 126 and includes a capillary tube upper section 146*a* positioned generally within the head casing assembly 126 and a capillary tube assembly lower section 146*b* which extends from the bypass 130, through the elbow 134, through the riser 148 and into the head casing assembly 126.

The riser 148 is capped within the head casing assembly 126 by a buffer subassembly 150, which can be similar to the buffer subassembly 50 described above. The capillary tube assembly lower section 146*b* passes through the buffer subassembly 150 and terminates at a capillary tube elbow 152 which is connected to the capillary tube upper section 146*a*. The head casing assembly 126 includes a casing base 168 which has a base capillary passage 170 formed therein and connected to the capillary tube assembly upper section 146*a* by a suitable capillary tube assembly junction fitting 172. A capillary tube assembly inlet port 174 is accessible externally to the head casing assembly 126 and provides a means for injecting appropriate liquids into the capillary tube assembly 146 and vents into the casing 106.

Moreover, an access housing for a capillary tube assembly as described above could be mounted on the elbow 134 between its second, upper end 134*b* and the riser 148.

VII. Second Modified Wellhead Junction System 202

A wellhead junction system comprising a second modified or alternative embodiment of the present invention is shown in FIGS. 11–16 and generally includes a conduit subsystem 224, a head casing assembly 226 and a connector assembly 228.

The conduit subsystem 224 includes a bypass 230 and an access housing 236 mounting a collar 238 and a foot 240. An elastomer buffer 240*a* and a buffer retainer 240*b* are located in the upper end of the access housing 236 below the foot 240. The foot 240, buffer 240*a* and the buffer retainer 240*b* are penetrated by a plurality (e.g., three) of conductor passages 240*c*. A flexible, corrugated hose guard 242 is mounted on and extends from the foot 240 at a first end 242*a* thereof in an inverted U-shaped configuration to the head casing assembly 226 at a second end 242*b* thereof. The hose 242 receives three gooseneck, high-pressure hoses 244 therein, each functioning as a conduit for a respective conductor 218*a,b,c*. Each high pressure hose 244 mounts a respective male-threaded fitting 244*a* on each end thereof. A flexible metal hose leader 248 is mounted on a lower end of the head casing assembly 226 and receives the power cable conductors 118*a,b,c* of the source lead 220*a*. A capillary tube subassembly 246 is located in the access housing 236 and extends downhole into the well casing.

The head casing assembly 226 includes a body 250 with upper and lower sections 250*a,b* connected by a body flange connection 250*c* and forming body section upper and lower ends 250*d,e*. A body top plug 252 is mounted in the body upper end 250*b* and includes a plurality of conductor passages 254 extending therethrough. Access ports and bolt seals 256 are placed at appropriate radial intervals around the body 250. A bottom cover 258 is mounted on the body lower end 250*e* and includes a stub 260 which mounts the flexible metal hose leader 248.

The connector assembly 228 includes a nylon insulator 262 located within the body bore 250*f* and having a plurality of conductor passages 262*a* extending therethrough. The connector assembly includes three connector subassemblies 228*a,b,c* each providing the electrical connection for a respective power cable conductor 218*a,b,c*. Each connector subassembly 228*a,b,c* includes a respective upper sleeve 264*a* extending from the top plug 252 to the nylon insulator 262 and a lower sleeve 264*b* extending downwardly from the nylon insulator 262. The sleeves 264*a,b* preferably comprise insulating material. The lower sleeves 264*b* are received in respective tubes 266, which can comprise stainless steel and can be mounted on a connector assembly base 268. Each connector subassembly 228*a,b,c* includes a connector pin 270 with a hollow upper end 270*a* receiving a stripped end of a respective power cable conductor 218*a,b,c* of a source lead 220*a* and a lower end 270*b* electrically connected to a respective power cable conductor 218*a,b,c* of the power cable device lead 220*b*. The body lower section 250*b* includes a lower plug-in nylon insulator 272 which can receive hollow, conductive end terminals 274 of the device lead conductors 218*a,b,c* for conductive placement on the pin lower ends 270*b*. An air vent 276 is provided in the top plug 252 and the body bore 250*f* can be filled with a suitable non-conductive material, such as silicon, between the top plug 252 and the upper nylon insulator 262.

Each connector subassembly 228*a,b,c* includes a lug 278 comprising a body 278*a* receiving a pin upper end 270*a* and set screw 278*b* for grippingly compressing the pin upper end 270*a* onto the wire strands of a respective power cable device lead conductor 218*a,b,c*. The lugs 278 are accessible through the access ports and bolt seals 256. An O-ring 280 is located between the base 268 and the lower insulator 272. A safety union subassembly 282 is provided for connecting the foot 240 to the top plug 252 and includes a foot strap 284 connected to the foot 240 and extending outwardly therefrom and a top plug strap 286 connected to the top plug 252 and extending outwardly therefrom. The safety union subassembly straps 284, 286 are adjustably interconnected by a safety union bolt 288.

VIII. Third Modified Wellhead Junction System 302

Figure 17:
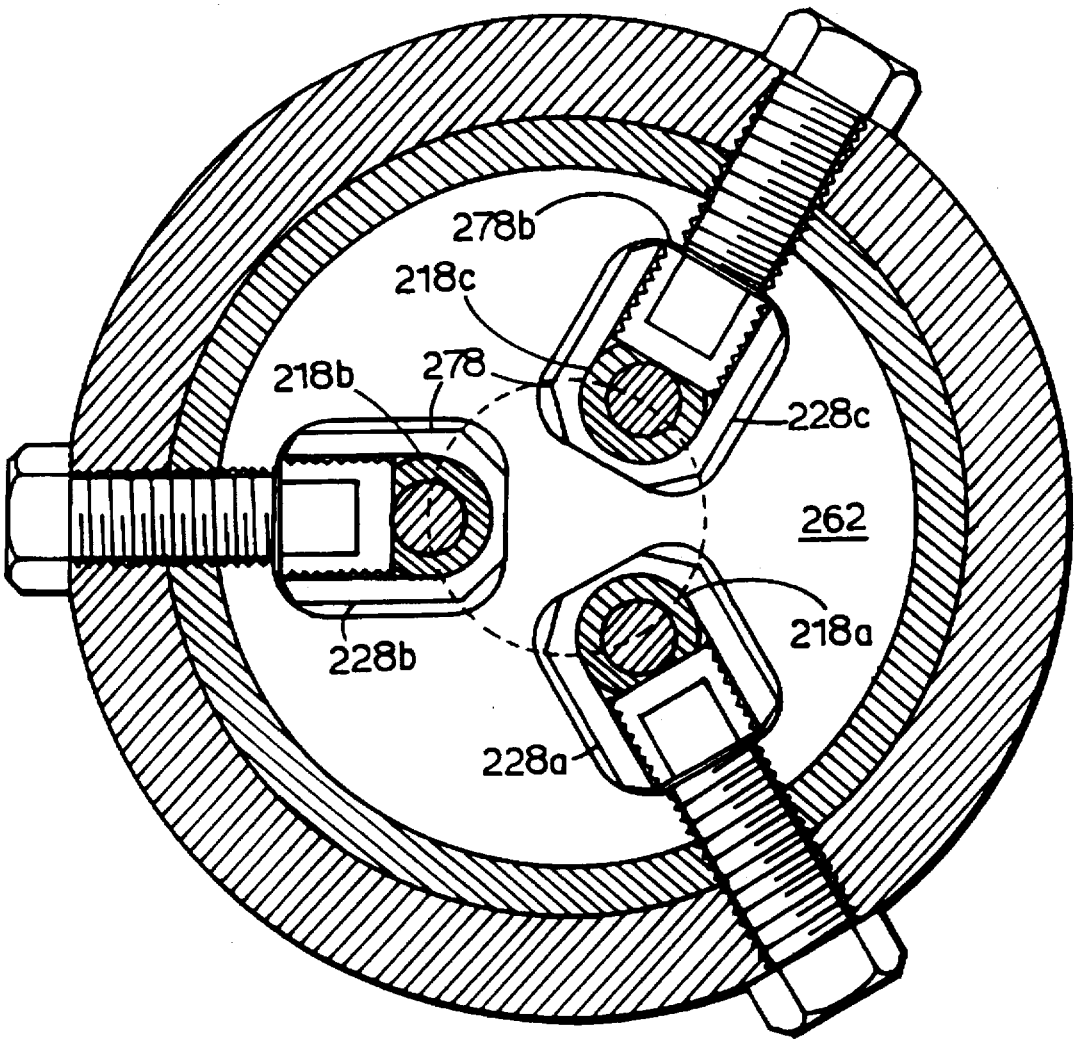
FIG. 17 is a horizontal, cross-sectional view thereof taken generally along line 17—17 in FIG. 14.
Figure 18:
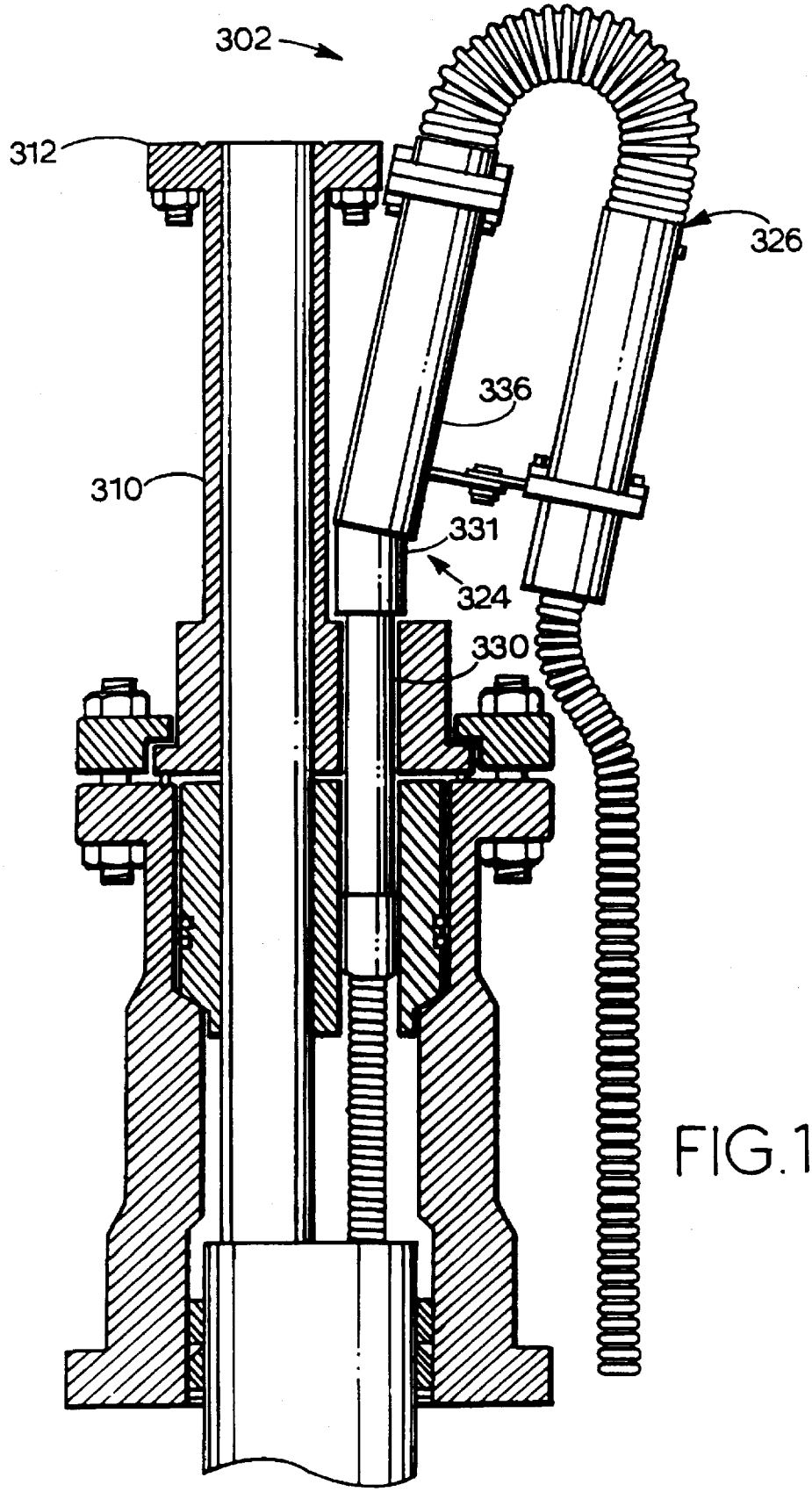
FIG. 18 is a vertical, cross-sectional view of a junction system for a wellhead comprising a third modified embodiment of the present invention with a 12° elbow mounting an access housing thereof on a bypass tube.

A third modified wellhead junction system embodying the present invention is shown in FIG. 17 and is generally designated by the reference 302. The third modified wellhead junction system 302 includes a conduit subassembly 324, a head casing assembly 326 and a connector assembly (not shown) within the head casing assembly 326.

The wellhead junction system 302 is generally similar to the second modified wellhead junction system 202 described above except that a 12° elbow 331 is mounted on the bypass 330 and mounts the access housing 336. The 12° elbow 331 positions the wellhead junction system 302 to the side of the tubing head 310 which includes an upper flange 312 mounting a piece of equipment associated with production or the like.

The wellhead junction system 302 is particularly well adapted for low-pressure wellhead applications.

It is to be understood that while certain forms of the present invention have been illustrated and described herein, it is not to be limited to the specific forms or arrangement of parts described and shown.

What is claimed and desired to be secured by Letters Patent is as follows:

1. A junction system for a power cable including an electrical conductor, a device lead and a source lead at a wellhead, which includes:

(a) a bypass tube connected to the wellhead and having a lower end positioned in the wellhead and an upper end extending upwardly therefrom;

(b) a riser tube having a lower end connected to the bypass tube upper end and an upper end;

(c) a head casing assembly including a casing body having upper and lower ends, said riser tube extending through said casing body lower end;

(d) said casing body forming a bore therein; and (e) an electrical connector positioned within said casing body bore and electrically connecting said power cable device lead and source lead.

2. The system according to claim 1, which includes:

(a) said wellhead having a tubing hanger with a bypass passage extending therethrough; and (b) said bypass tube extending through said tubing hanger bypass passage.

3. The system according to claim 1, which includes:

(a) said wellhead including capillary tubing;

(b) an access housing having a lower end mounted on said bypass tube upper end and an upper end mounting said riser tube lower end; and (c) an access port connected to said capillary tube.

4. The system according to claim 1, which includes:

(a) a buffer subassembly mounted in said riser tube upper end and having a passage receiving said power cable device lead; and (b) said buffer subassembly including a fluid-pervious filter.

5. The system according to claim 3, which includes:

(a) said access housing and said head casing assembly being positioned in substantially parallel, spaced relation;

(b) said electrical cable device lead having a plurality of conductors extending between said access housing upper end and said head casing assembly;

(c) a corrugated hose guard extending between said access housing upper end and said head casing assembly; and (d) a plurality of fluid pressure hoses extending between said access housing upper end and said head casing assembly within said corrugated hose guard, each said fluid pressure hose receiving a respective electrical conductor.

6. The system according to claim 1 wherein:

(a) said head casing body includes upper and lower sections and a base positioned between said casing body sections and mounting same.

7. The system according to claim 6 wherein said head casing assembly includes:

(a) a bore having upper and lower chambers within said casing body upper and lower sections, said bore having upper and lower casing body chambers formed in said upper and lower sections respectively; and (b) said riser tube extending through said head casing assembly base and terminating in said upper chamber.

8. The system according to claim 1, which includes:

(a) said electrical connector assembly being mounted on said head casing assembly base and connected to said device lead in said upper chamber and being connected to said source lead in said lower chamber.

9. The system according to claim 8, which includes:

(a) an insulator positioned within said upper chamber and having a riser passage receiving said riser tube and a conductor passage receiving a conductor of said device lead.

10. A junction system for a well having a wellhead mounted on a well casing and including a tubing hanger, the well further including a power cable with a source lead connected to an electrical power source, a device lead connected to an electrical submersible pump associated with the casing and a plurality of electrical conductors, which junction system comprises:

(a) a bypass tube with a lower end extending into the wellhead and an upper end protruding upwardly therefrom;

(b) a riser tube having a lower end connected to the bypass upper end and an upper end;

(c) a head casing assembly including:

(1) a casing body with a lower end receiving said riser tube, a closed upper end and a casing body bore; and (2) a head casing assembly base positioned within said casing body bore and including a riser passage receiving said riser and a plurality of electrical connector assembly passages; and (d) a plurality of electrical connector assemblies mounted on said base and extending through respective electrical connector passages therein, each said electrical connector assembly having an upper end connected to a respective conductor of said device lead above said base and a lower end connected to a respective conductor of source lead below said base.

11. The system according to claim 10, which includes:

(a) a buffer subassembly mounted in said riser upper end and including an electrical cable passage extending therethrough.

12. The system according to claim 10, which includes:

(a) a 180° bend of said power cable device lead.

13. The system according to claim 10, which includes:

(a) a non-conductive insulator positioned within said head casing bore on top of said base and having an insulator cable passage and an insulator riser passage receiving said cable and said riser respectively.

14. The system according to claim 10, which includes:

(a) each said connector assembly having an upper end connected to a respective conductor of said device lead and a lower end connected to a respective conductor of said power lead; and (b) said connector assemblies extending through said head casing assembly base.

15. The system according to claim 14 wherein each said connector assembly includes:

(a) a conductor stud extending through a respective base connector passage;

(b) a liner receiving said conductor stud;

(c) a sleeve having a lower section receiving said liner and an upper section receiving said connector stud upper end;

(d) upper and lower conductor nuts mounted on said sleeve lower section and engaging said base therebetween; and (e) a conductor plug mounted on said sleeve upper section and having a passage receiving a respective cable device lead conductor.

16. The system according to claim 15 wherein each said connector assembly includes:

(a) a conductive crimp fastener with a lower end threadably mounted on a respective conductor stud upper end and a crimp fastener upper end receiving a respective device lead conductor in a gripping, conductive relationship therewith;

(b) a housing mounted on said conductor stud lower end;

(c) a pair of conductor nuts mounted on said conductor stud lower end; and (d) each said source lead conductor having a conductor end clampingly and conductively mounted between said conductor nuts.

17. The system according to claim 10, which includes:

(a) a flexible metal hose leader enclosing said power lead below said head casing assembly.

18. The system according to claim 10, which includes:

(a) said head casing assembly including an insulator with a riser passage and a plurality of conductor passages extending therethrough; and (b) said insulator having first and second sections each having a portion of said riser passage formed therein.

19. The system according to claim 10, which includes:

(a) a buffer subassembly with a threaded plug mounted on said riser upper end, a filter sealingly engaging a device lead conductor and a pair of plates positioned above and below said filter, said filter being positioned below said plug.

20. The system according to claim 15 wherein each said connector assembly includes:

(a) a plurality of O-rings positioned in said sleeve upper section and sealingly engaging a respective conductor of said device lead.

21. The system according to claim 10 wherein:

(a) said power cable device lead includes an insulation layer which terminates at a splice wrap located within said riser tube.

22. The system according to claim 10, which includes:

(a) a head casing lower cover mounted on said head casing lower end below the base thereof.

23. The system according to claim 10, which includes:

(a) an access housing located between said riser tube and said bypass tube;

(b) a capillary tube assembly terminating in said access housing and having a capillary tube located therein and extending through said bypass into said well casing; and (c) a capillary tube access port on said access housing and connected to said capillary tube.

24. The system according to claim 10, which includes:

(a) an elbow with a first section connected to said bypass tube upper end and a second section connected to said riser tube lower end.

25. The system according to claim 19 wherein:

(a) said buffer subassembly includes a gas permeable filter.

26. The system according to claim 19, which includes:

(a) an inert liquid with a specific gravity greater than one within said head casing bore.

27. The system according to claim 26, which includes:

(a) primary seal means formed by said plug; and (b) secondary seal means formed by said inert liquid.

28. The system according to claim 15, which includes:

(a) a sleeve mounted within said head casing bore and extending through the said base connector passage, said sleeve receiving a liner and said liner receiving said conductor.

29. A pressure-sealing electrical connector assembly for a conductor with first and second leads, which includes:

(a) a casing body with a first section having a end and a second section having a second end and a bore with first and second chambers formed in said first and second sections respectively;

(b) a casing base connected to said casing body sections and located therebetween, said casing base having a connector passage;

(c) a connector stud including a first end positioned within said first chamber and connected to said conductor first lead therein and a second end positioned within said second chamber and connected to said second lead therein;

(d) a liner having a passage receiving said conductor stud; and (e) a sleeve having a sleeve first section receiving said conductor stud first end and being located within said first chamber and a sleeve second section extending through said base connector passage and receiving said liner.

* * * * *